United States Patent [19]

Mowrey, Jr.

[11] 3,945,528

[45] Mar. 23, 1976

[54] APERTURED LID AND METHOD FOR MANUFACTURING SAME

[75] Inventor: Melvin Mowrey, Jr., Reisterstown, Md.

[73] Assignee: Maryland Cup Corporation, Owings Mills, Md.

[22] Filed: Feb. 24, 1975

[21] Appl. No.: 552,663

Related U.S. Application Data

[63] Continuation of Ser. No. 298,519, Oct. 18, 1972.

[52] U.S. Cl. ..... 220/265; 215/250; 220/367; 229/7 R

[51] Int. Cl.[2] ..... B65D 41/02

[58] Field of Search ..... 220/265, 367; 215/250, 215/253; 229/7 R, 43; 137/525.1, 525.3, 493

[56] References Cited

UNITED STATES PATENTS

| | | | |
|---|---|---|---|
| 1,593,785 | 7/1926 | Wilson | 215/253 |
| 1,632,412 | 6/1927 | McCrystal | 229/7 R |
| 2,082,760 | 6/1937 | Berni | 229/7 R |
| 2,335,832 | 11/1943 | Williams | 137/525.1 |
| 2,436,291 | 2/1948 | Daniel | 215/247 |
| 2,578,244 | 12/1951 | Harrison | 229/7 R |
| 3,387,765 | 6/1968 | Davis | 220/367 |

FOREIGN PATENTS OR APPLICATIONS

| | | | |
|---|---|---|---|
| 544,271 | 4/1942 | United Kingdom | 215/56 |

*Primary Examiner*—William Price
*Assistant Examiner*—Ro E. Hart
*Attorney, Agent, or Firm*—Birch and Birch

[57] ABSTRACT

A method and means for manufacturing a plastic lid with a frangible portion to facilitate the formation of an aperture is described. In one embodiment a platen having ruled steel cutting blades mounted thereon is pressed against a plastic lid backed up by a hardened steel anvil with sufficient force to merely score the plastic lid in accordance with the pattern of the cutting blades without actually breaking through the plastic lid. The scored area which forms said frangible portion of the lid may then be easily punctured to form a straw-slot or vent opening. In another embodiment the cutting tool used comprises two cutting blades disposed on intersecting paths, each blade having a portion removed adjacent the point of intersection of said paths. In this embodiment the cutting blades are permitted to cut completely through the lid leaving a diamond-shaped weakened area in the region corresponding to the intersection of said cutting blades. This diamond-shaped portion can be easily fractured by pressing a straw or other suitable means through the lid at that point. This embodiment also provides a substantially leak-proof closure lid.

2 Claims, 4 Drawing Figures

APERTURED LID AND METHOD FOR MANUFACTURING SAME

This is a continuation of application Ser. No. 298,519, filed Oct. 18, 1972.

BACKGROUND OF THE INVENTION

1. Statement of Invention

This invention relates to an apparatus and method for forming a straw-slot or vent-opening in a plastic lid which will be substantially air tight and leak proof until ready for use in the desired mode.

2. Description of Prior Art

Heretofore straw-slots or vent-openings in plastic lids have been made by tools which completely penetrate the thickness of the plastic lid thereby forming an opening through which the contents of the container on which it is used may leak. Plastic lids of this type are disclosed in U.S. Pat. No. 3,387,765 to Paul Davis, assigned to the assignee of the present invention.

Due to the nature of the opening disclosed in the foregoing mentioned patent, it is not suitable for use on containers which must be completely sealed from the ambient atmosphere.

Therefore, when using the lid of said patent or other similar lids, a merchant must keep in inventory an additional supply of lids which facilitate the complete sealing of a container to prevent leakage therefrom.

SUMMARY OF INVENTION

Accordingly, it is an object of the present invention to provide an apparatus and method for forming a lid which in its original form contains substantially no openings therein but which may be easily punctured by a straw or other suitable means just prior to use.

It is a further object of the present invention to provide a novel configuration of cutting blades for scoring the closure lid in a selected area.

It is a further object of the present invention to provide a novel plastic closure lid with a straw-slot or vent-opening therein which may be easily formed in an in-line process with the lid per se.

These and other objects of the present invention will become more apparent with reference to the following drawings wherein.

Figure 1:
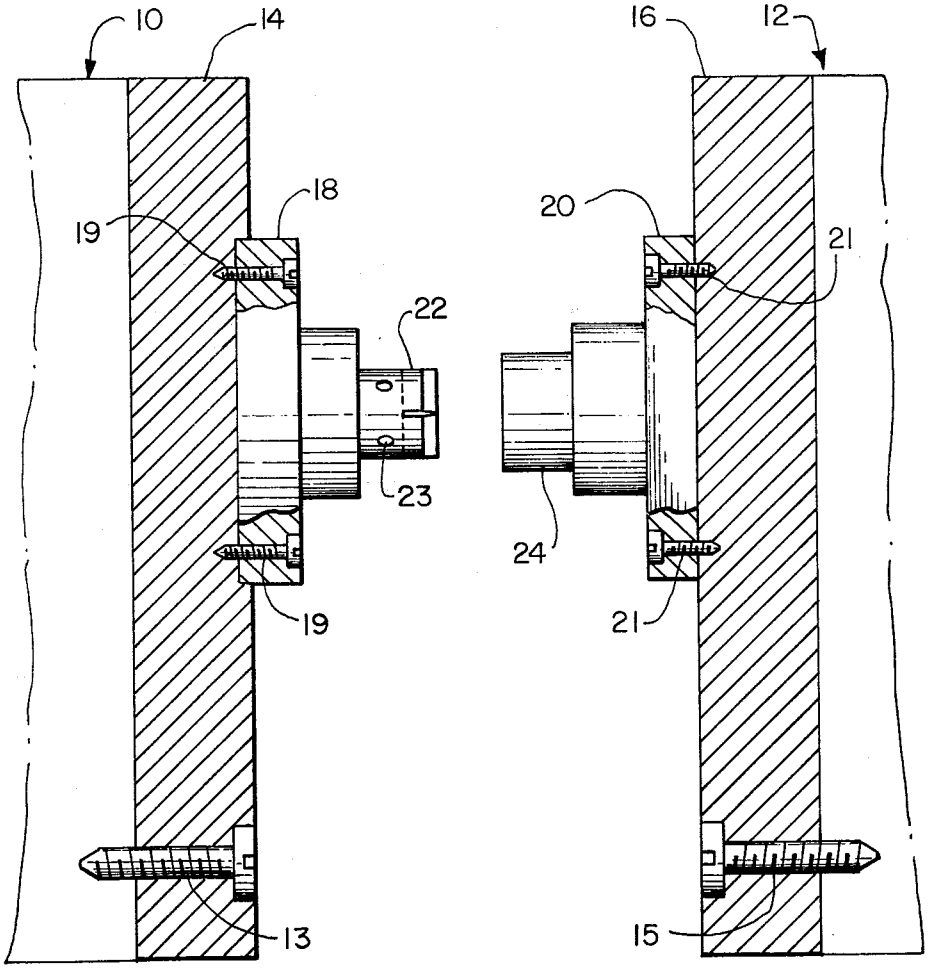
FIG. 1 is a side elevational view of an apparatus for scoring the lid of the present invention.

Referring in detail to FIG. 1, there is shown a moving platen 10 disposed in alignment with a stationary platen 12. Platen 10 has a mounting plate 14 disposed thereon which may be attached by a mounting bolt as shown at 13.

Figure 3:
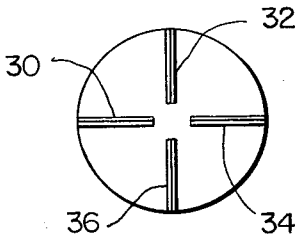
FIG. 3 is an end plan view of another embodiment of a cutting blade configuration suitable for use in the apparatus of FIG. 1.
Figure 2:
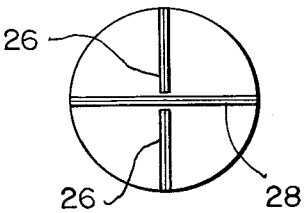
FIG. 2 is an end plan view of a cutting blade configuration used in the apparatus of FIG. 1.

A cutter holder 18 is secured to mounting plate 14 by bolts 19 or other suitable means. A cutting means generally indicated at 22 is supported in holder 18 be a suitable means. In a preferred embodiment cutting means 22 may be screwed into holder 18 to facilitate easy removal therefrom. Cutting means 22 may be provided with a plurality of removable steel rule cutting blades in selected configurations as shown in FIGS. 2 and 3. The cutting blades are removable and adjustable in cutting means 22. Set screws may be provided at 23 to hold the cutting blades in place.

A mounting plate 16 is provided on stationary platen 12 and is secured thereto by bolts such as shown at 15. An anvil holder 20 is secured to mounting plate 16 by bolts 21. A hardened steel anvil 24 is disposed in anvil holder 20. The apparatus shown in FIG. 1 in a preferred embodiment is disposed in the trim press of a lid forming machine to facilitate the in-line production of the straw or vent holes within the lid-forming machine.

Referring to FIG. 2, there is shown a first embodiment of the cutting blade configuration for use in cutting means 22 of FIG. 1. This blade configuration comprises two steel rule blades 26 and 28 disposed on intersecting paths. Blade 26 has a portion removed therefrom in the area adjacent the point of intersection of said paths.

When using the blade configuration of FIG. 2 the moving platen 10 of FIG. 1 is moved toward stationary platen 12 until cutting blades 26 and 28 contact a plastic lid (not shown) disposed on hardened steel anvil 24. Platen 10 is driven only far enough and with enough force to score the plastic lid in a selected area without actually penetrating the thickness of the lid. However, due to the configuration of the score lines the plastic lid is sufficiently weakened in said selected area to facilitate the easy puncture of said area with a conventional drinking straw or other suitable means when access to the container is desired.

Referring to FIG. 3, there is shown another embodiment of a cutting blade configuration suitable for use with the cutting means of FIG. 1. As shown in FIG. 3, there are four steel rule cutting blades 30, 32, 34, and 36 provided which are disposed on two intersecting paths. Each of said blades 30, 32, 34, and 36 extend up to a point short of the point of intersection of said paths.

Figure 4:
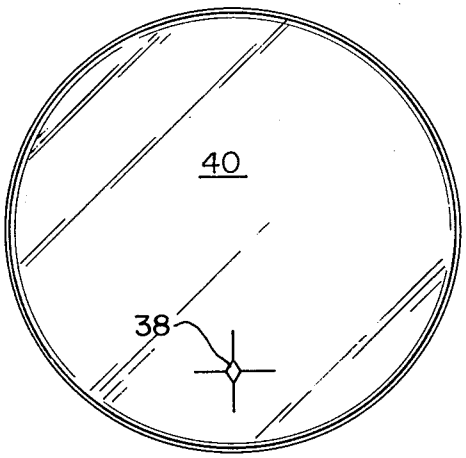
FIG. 4 is a top plan view of the closure lid formed by the cutting blade of FIG. 3.

When using the cutting blade configuration of FIG. 3 the moving platen 10 of FIG. 1 is moved against platen 12 with sufficient force to cause blades 30, 32, 34, and 36 to cut through the plastic lid disposed on anvil 24. The stress pattern caused by blades 30, 32, 34, 36 forms a diamond-shaped weakened area 38 in the area in lid 40 adjacent the point of intersection of the paths on which said cutting blades are disposed. See FIG. 4. This weakened diamond-shaped area may then be easily punctured by a conventional straw or other suitable means to form an opening in the lid.

The present invention may be modified as would occur to one of ordinary skill in the art without departing from the spirit and scope of this invention.

I claim:

1. A thin-walled plastic closure lid for a container, said plastic characterized by the property of exhibiting stress patterns in areas proximate to cuts in said lid in response to the formation of said cuts, said stress pattern causing the weakening of said plastic in the area thereof, said lid having a frangible portion for selectively providing a straw receiving aperture therein, said fragible portion comprising:

a first continuous score line on a surface of said lid extending along a first path; a second score line on said surface extending along a second path which intersects said first path at a predetermined point, said second score line stopping short of said predetermined point on both sides thereof on said second path;

said score lines being of sufficient depth to facilitate puncturing of said lid in the area of said score lines to form a straw receiving aperture in said lid;

said frangible portion being air tight and leak proof prior to puncturing.

2. A thin-walled plastic closure lid for a container, said plastic characterized by the property of exhibiting stress patterns in areas proximate to cuts in said lid in response to the formation of said cuts, said stress pattern causing the weakening of said plastic in the area thereof, said lid having a frangible portion for selectively providing a straw receiving aperture therein, said frangible portion comprising:

a plurality of cuts disposed along two paths which intersect at a predetermined point, said cuts stopping short of said predetermined point defining a diamond-shaped area which is weakened by the stress pattern of said cuts, thereby facilitating the puncturing of said lid in the diamond-shaped area to form an aperture in said lid;

said frangible portion being substantially leak proof prior to puncturing.

* * * * *